US007326838B1

(12) United States Patent
Bunker

(10) Patent No.: US 7,326,838 B1
(45) Date of Patent: Feb. 5, 2008

(54) ADJUSTABLE GUITAR NECK MEMBER

(76) Inventor: David Bunker, HC60 - Box 405, Mona, UT (US) 84645

( * ) Notice: Subject to any disclaimer, the term of this patent is extended or adjusted under 35 U.S.C. 154(b) by 141 days.

(21) Appl. No.: 11/149,973

(22) Filed: Jun. 10, 2005

Related U.S. Application Data

(60) Provisional application No. 60/578,534, filed on Jun. 10, 2004.

(51) Int. Cl.
*G10D 3/00* (2006.01)

(52) U.S. Cl. ..... 84/293; 84/267

(58) Field of Classification Search ..... 84/293, 84/290, 291, 267
See application file for complete search history.

(56) References Cited

U.S. PATENT DOCUMENTS

| | | | | |
|---|---|---|---|---|
| 1,912,106 | A | 5/1933 | Turturro | |
| 2,056,747 | A | 10/1936 | Low | |
| 2,478,136 | A | 8/1949 | Stromberg | |
| 2,964,985 | A | 12/1960 | Webster | |
| 2,998,742 | A | 9/1961 | Pratt | |
| 3,159,072 | A | 12/1964 | Burns et al. | |
| 3,196,730 | A | 7/1965 | Daniel | |
| 3,251,257 | A | 5/1966 | Bunker | |
| 3,396,284 | A | 8/1968 | Scherer | |
| 3,396,621 | A | 8/1968 | Dycus | |
| 3,418,876 | A | 12/1968 | Dopyera | |
| 3,483,303 | A | 12/1969 | Warner | |
| 3,657,462 | A | 4/1972 | Robinson | |
| 3,858,480 | A | 1/1975 | Schnieder et al. | |
| 3,974,730 | A | 8/1976 | Adams, Jr. | |
| 4,004,485 | A | 1/1977 | Hiscott | |
| 4,169,402 | A | 10/1979 | Wood | |
| 4,241,637 | A | 12/1980 | Brent | |
| 4,373,417 | A | 2/1983 | Wilson et al. | |
| 4,432,267 | A | 2/1984 | Feller | |
| 4,530,268 | A | 7/1985 | Starrett | |
| 4,557,174 | A | 12/1985 | Gressett, Jr. | |
| 4,580,480 | A | 4/1986 | Turner | |
| 4,620,470 | A | 11/1986 | Vogt | |
| 4,722,260 | A | 2/1988 | Pigozzi | |
| 5,018,423 | A | 5/1991 | Bunker et al. | |
| 5,421,233 | A * | 6/1995 | Bunker | 84/293 |
| 6,831,218 | B2 * | 12/2004 | Steinberger | 84/293 |
| 2002/0050204 | A1 * | 5/2002 | Wilfer | 84/293 |

FOREIGN PATENT DOCUMENTS

| | | |
|---|---|---|
| CH | 248509 | 2/1948 |

* cited by examiner

*Primary Examiner*—Lincoln Donovan
*Assistant Examiner*—Jianchun Qin
(74) *Attorney, Agent, or Firm*—Thorpe North & Western LLP

(57) ABSTRACT

An adjustable neck member is disclosed having a distal end and a mounting end configured to be coupled to a stringed instrument body. An enclosed channel extending within the neck member from a position near the mounting end and along a central axis of the neck member to the distal end is also provided. The channel may include at least one recess extending laterally from the channel at the distal end. Furthermore, a rigid bar disposed within the channel and having an adjustment end, an opposing distal end, a stabilizing pin, and a transverse pivot support that is configured to vertically displacement of the neck member is also included. In one embodiment the neck member may also include a pressure isolating means which is capable of indirectly applying sufficient pressure to the neck member to reduce any resonating spring vibrations.

15 Claims, 2 Drawing Sheets

ADJUSTABLE GUITAR NECK MEMBER

PRIORITY DATA

The present non-provisional application claims the benefit of U.S. Provisional Application No. 60/578,534 filed Jun. 10, 2004, which is incorporated herein by reference.

FIELD OF THE INVENTION

The present invention relates to an adjustable neck member for stringed instruments. More particularly, the present invention relates to a neck member having a stabilizing pin and a pressure-isolating means which is capable of limiting rotational neck movement and reducing any string resonating vibrations.

BACKGROUND OF THE INVENTION

Adjusting the neck on stringed instruments such as guitars and banjos for example, and maintaining proper neck alignment, has been a challenge for years because a significant amount of force is continuously applied to the neck by a plurality of strings in tension. The spacing between the fingerboard and the strings must be consistent along the length of the neck. Such positioning is even more critical where frets are inlaid in the fingerboard to enable pitch selection of any selected string by depressing one or more fingers on a distal side of the fret from the resonating chamber or pickup part associated with the body of the stringed instrument.

Proper alignment of the fingerboard of a guitar with respect to the suspended strings is essential. Although spacing and height displacement of strings from the fingerboard can be partially adjusted by the use of a specifically configured bridge or nut, it is preferred that the fingerboard of a guitar be straight and generally flat (meaning nontwisted) so that initial adjustments of the fingerboard position with respect to the rest of the instrument can be made in a predictable and controlled manner, remaining uniform for all frets along the fingerboard length.

In conventional fabrication of guitars, the neck member is often initially bowed or even twisted, if only slightly. Many of these faulty necks must be discarded. For some, adjustments can be made to properly position the fingerboard with respect to the strings. However, correction of subsequent rotational and/or lateral misalignments are very difficult where the fingerboard is not initially flat, and compensation is virtually impossible when attempted from the outset for an extreme bow or twisted neck structure.

Even where the neck structure remains acceptable after initial tooling, when applied to the guitar and subjected to stringed forces of 175 to 200 pounds of compression, misalignment of the neck structure may result. Because of the unpredictable response of wood composition, guitar neck components cannot easily be prestressed to allow compensation for adjustments resulting from the described string pressure or loading which are imposed upon the neck.

Furthermore, the prior problems of stress-imposed changes within the neck structure continue to be troublesome because forces arising from strings in tension can also affect distortion in the neck structure, particularly where weather conditions, heat and humidity might affect the wood. Therefore, a common impediment to construction and maintenance of a flat fingerboard and predictably straight neck body is the loading of the neck structure with the forces imposed by the tightly strung strings. Such stress is applied to the neck in conventional manner.

While adjustments, proper neck position and form are important to producing quality guitar necks. It is also important to provide a guitar neck that is aesthetically pleasing to the buyer. Therefore, methods are needed to provide a way to efficiently mass produce the guitar necks, while maintaining the guitar neck quality and appearance. Typically, a guitar neck member is produced in several steps and with distinct parts. Specifically, the neck body is cut and shaped separately from a peg head. Once the two pieces (neck body and peck head) have been cut and shaped they are then combined and further shaped in a less efficient process to provide proper alignment giving the neck member the appearance of one continuous piece.

Although the collective approaches in the prior art have improved somewhat the state of the art in the field of stringed instruments, they are nonetheless fraught with disadvantages. Complete modularity of the neck member has still not been achieved, and adjustment mechanisms on the instrument body causes interior deformation in the instrument body, and the relative position of said adjustment mechanism and the body is often a source of unwanted vibration in the sound output of the instrument.

Therefore, a neck member that is capable of being adjusted and reduces unwanted vibrations while is easily fabricated in a time and cost efficient process and still aesthetically pleasing continues to be sought.

SUMMARY OF THE INVENTION

Accordingly, the present invention provides an adjustable neck member for a stringed instrument that is capable of overcoming the disadvantages described above. Specifically, the adjustable neck member may include a distal end and a mounting end configured to be coupled to a stringed instrument body. In addition, an enclosed channel extending within the neck member from a position near the mounting end and along a central axis of the neck member to the distal end is provided. The channel may include at least one recess extending laterally from the channel at the distal end. Furthermore, the invention may include rigid bar disposed within the channel and having (i) an adjustment end configured for positioning proximate to the instrument body and configured to receive an adjustment mechanism; (ii) an opposing distal end extending toward the distal end of the neck member; (iii) a stabilizing pin disposed near the distal end to be received in said at least one recess; and (iv) a transverse pivot support coupled proximate to the mounting end of the bar, thereby enabling the neck member to vertically displace. The adjustment mechanism may be configured to engage the adjustment end of the rigid bar for enabling the neck member to vertically displace.

In one embodiment the neck member may also include a pressure isolating means having a partially enclosed cylinder configured for mounting within the instrument body, a blocking flange coupled to the adjustment mechanism and a spring disposed between the flange and the cylinder. Accordingly, the pressure isolating means can be capable of indirectly applying sufficient pressure to the neck member to reduce any resonating spring vibrations.

The present invention also encompasses an adjustable neck member having a distal end and a mounting end configured to be coupled to a stringed instrument body. In addition, the embodiment may provide an enclosed channel extending within the neck member from a position near the mounting end and along a central axis of the neck member to the distal end and a rigid bar disposed within the channel and having (i) an adjustment end configured for positioning proximate to the instrument body and configured to receive an adjustment mechanism; (ii) an opposing distal end extending toward the distal end of the neck member; (iii) a stabilizing structure disposed near the distal end configured to reduce rotational movement of the neck member; and (iv) a transverse pivot support coupled proximate to the mounting end of the bar, thereby enabling the neck member to vertically displace. Furthermore, the embodiment can provide a pressure isolating means having a partially enclosed cylinder configured for mounting within the instrument body, a blocking flange coupled to the adjustment mechanism and a spring disposed between the flange and the cylinder. The pressure isolating means can be capable of indirectly applying sufficient pressure to the neck member to reduce any resonating spring vibrations and the adjustment mechanism can be configured to engage the adjustment end of the rigid bar for enabling the neck member to vertically displace.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

BRIEF DESCRIPTION OF DRAWINGS

The above and other objects, features and advantages of the invention will become apparent from a consideration of the subsequent detailed description presented in connection with the accompanying drawing in which.

DETAILED DESCRIPTION OF THE INVENTION

Figure 1:
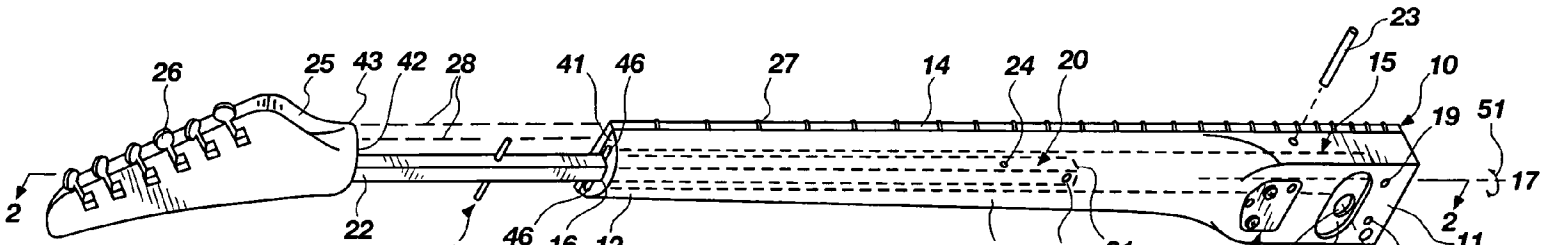
FIG. 1 shows a partially exploded, perspective view of an accessory neck/fingerboard member, made in accordance with the principles of the present invention, including a peg head for suspending strings of the instrument over the fingerboard.

Reference will now be made to the drawings wherein like structures will be provided with like reference numerals.

FIG. 1 shows a guitar neck, designated generally at 10, which includes a mounting end 11, a distal end 12, a fingerboard/top surface 14 and an opposing back surface 13. The phrase "fingerboard/top surface" as used herein refers to a top surface 14 of the neck member 10, wherein said top surface 14 can be attached to a fingerboard or operate as a fingerboard itself. The back surface 13 includes a recessed portion formed therein to provide a blocking flange mounting surface 37. Included within the neck is an enclosed channel 15 which is positioned near the mounting end 11 and extends to an opening 16 at the distal end of the neck. This channel extends substantially along a central axis 17. The mounting end 11 includes openings 19 for screws to attach the neck to a guitar body (not shown in FIGS. 1-2). The guitar neck is not inclusive to an accessory guitar neck, it may be a neck incorporated in custom guitars.

A rigid bar 20 may be disposed within the channel 15 and includes an adjustment end 21 which is configured for positioning proximate to the instrument body and configured to receive adjustment mechanism 30 (not shown in FIGS. 1-2), a distal end 22, a stabilizing pin 40 located near distal end 22 to be received in at least one recess 46, and a transverse pivot support 23 and support opening 24 within an intermediate section of bar 20. The distal end 22 of the bar 20 is rigidly attached to a peg head 25 which may include attendant tuning structure 26. This attachment is of a very sturdy nature to inhibit relative rotational movement or other relative displacement between the peg head 25 and the distal end 22 of the bar 20.

Conversely, a rigid bar 20 can be disposed within the channel 15 and includes an adjustment end 21 which is configured for positioning proximate to the instrument body and configured to receive adjustment mechanism 30, a distal end 22, a stabilizing structure (not shown) located near distal end 22 and a transverse pivot support 23. The stabilizing structure may be a stabilizing plate or any other structural means that can reduce or inhibit relative rotational movement or other relative displacement between the peg head 25 and the distal end 22 of the bar 20.

In an alternative embodiment, rigid bar 20 can be configured to be a round, octagonal, square or any shape. Typically, both the channel 15 and the rigid bar are rectangularly configured and sized to restrain relative rotational movement of the distal end of the bar with respect to the distal end of the neck. The preferred configuration is a square rigid bar. Furthermore, rigid bar 20 may be fabricated of any rigid conventional material such as metal, plastics, or composites. However, it is preferred to produce the rigid bar from metal material or the like.

Figure 8:
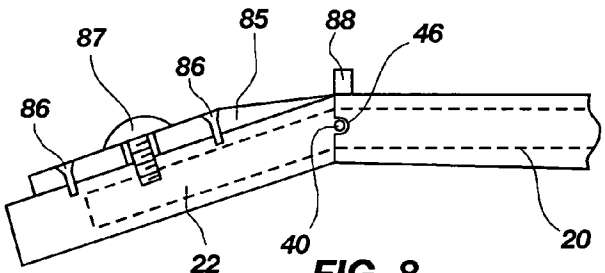
FIG. 8 shows a cut away view of an alternative embodiment of a standard nut being disposed on a guitar neck.

In an alternative embodiment, (shown in FIG. 8), A support plate 85 is fastened to peg head 25 by screws 86. Peg head 25 is rigidly attached to distal end 22 of bar 20 and the peg head 25 by at least one screw 87, thereby providing a solid attachment. A standard nut or bridge 88 is disposed on distal end 12 of fingerboard/top surface 14.

Figure 6:
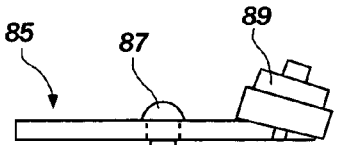
FIG. 6 shows a cut away view of a support plate receiving a locking nut.
Figure 7:
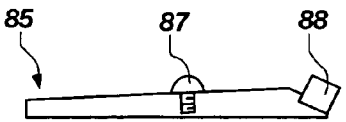
FIG. 7 shows a cut away view of a support plate receiving a standard nut.

In yet another alternative embodiment, (shown in FIGS. 6 & 7), support plate 85 receives a support screw 87 and can be configured to receive a standard nut 88 or a locking nut 89 to maintain the spacing and height displacement of strings from the fingerboard. Alternatively, the support plate can be configured to receive any style of nut. Notably, the standard nut or locking nut is optional, however, a nut may be placed on the distal end of the neck member instead of the supporting plate.

Furthermore, support plate 85 can be configured to maintain at least one instrument string but preferably a plurality of instrument strings at a predetermined distance above the neck member. The predetermined distance may be adjusted by manipulating the height of the support plate with spacing elements. Non-limiting examples of suitable spacing elements that may be used in accordance with the present invention are shims, spacers, nuts having varying heights, and a threaded rising member.

It should be noted that the described neck and peg head components may be fabricated of conventional material such as wood or plastics. However, it is preferred to make the neck from hard wood such as eastern maple or the like. Typically, the fingerboard is made of rose wood composition and frets 27 are of metal. Furthermore, it should also be noted that any type of a nut may be disposed on a support plate or fingerboard and may be fabricated of conventional material such as wood, metal or plastics. In addition, support plate 85 provides functionality to the guitar neck allowing the user to easily modify or change the type of nut used.

Figure 2:
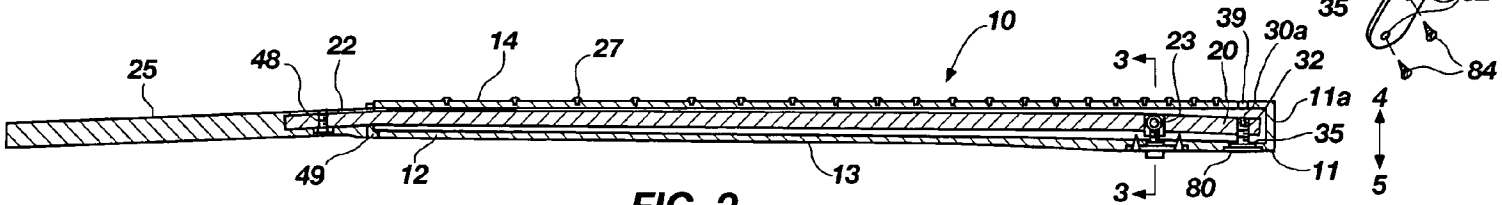
FIG. 2 shows a cut away view taken along section 2-2 of FIG. 1.

Strings 28 (shown in phantom line) as known in the art are held in tension between the peg head 25 and the instrument body (not shown in FIGS. 1-2). The bar 20 bears most of the compression imposed by the string tension in the strings 28, because of a tiny clearance space 49 separating the peg head 25 and the distal end 12 which is rigidly secured to the distal end 12 of the neck member 10. It will be appreciated that because there is clearance space 49 between the peg head 25 and the stabilizing pin 40, none of the neck member 10 between the stabilizing pin 40 and the pivot support 23 will be any of the load imposed by the string tension. Therefore, it is preferred that the bar 20 be made of rigid steel or other material capable of resisting such loads, and also of imposing adjustment forces appropriately within a neck structure. Cold rolled steel is a preferred material for the bar 20 because it maintains its orientation upon adjustment.

An exemplary embodiment of the bar 20 illustrated herein is of rectangular configuration having height and width dimensions which provide a snug fit for its distal end 22 within the distal end 12 of the neck member 10. This enables displacement of the distal end 22 of the bar 20 in opposing directions within a vertical plane substantially normal to the fingerboard/top surface 14, resulting in a corresponding displacement of the distal end 12 of the neck member 10. Stabilizing pin 40 is disposed near the distal end 22. The displacement is accomplished by a male-threaded screw 30 having a circular flange 35 coupled at a first end thereof. A threaded portion 32 of the screw 30 extends through an opening 31 in the flange mounting surface 37 so that said threaded portion 32 is engageable into a female-threaded opening 33 in the adjustment end 21 of the bar 20. The opening 31 is narrower than the flange 35 such that said flange 35 is rotatably sandwiched between the flange mounting surface 37 and a mounting plate 80. The mounting plate 80 is secured against the flange mounting surface 37 with one or more screws 84. This is illustrated more clearly in FIG. 2, showing a cross section of the assembled configuration.

It will be apparent that the screw 30 can be rotated clockwise or counterclockwise. A second end 30*a* of the screw 30 is accessible from a small access hole 39 formed in the fingerboard/top surface 14 of the neck member 10. The access hole 39 preferably has a diameter within a range of approximately ⅛ of and inch and 3/16 of an inch, and is preferably positioned within approximately 0.5 inches of a mounting extremity 11*a* (FIG. 2). The second end 30*a* includes a hexagonal slot formed therein, or some other non-circular slot 30*b* defined by side walls as known in the art, such that the slot is configured to receive an allen-wrench or other screw-turning device. A user rotates the screw 30 by inserting a screw-turning device through the access hole 39 and into said slot formed in the second end 30*a* of said screw 30, and turning said screw 30 therewith.

It will be appreciated that the screw 30 will be retained in its relative position with respect to the neck member 10 as shown in FIG. 2, while the coupled bar 20 will raise or lower, depending upon the direction of rotation of the threaded screw portion 32. This bi-directional displacement occurs about a pivotal support axis defined by the transverse pivot support 23 which provides a fulcrum position for the adjustable bar 20. When the screw 30 is rotated in a first direction, the flange mounting surface 37 operates as a restraining means and prevents movement of said screw 30 in a first axial direction 4 to thereby cause controlled displacement of the adjustment end 21 of the bar 20 in an opposing second axial direction 5. When the screw 30 is rotated in an opposing second rotational direction, the mounting plate 80 operates as a restraining means and prevents movement of said screw 30 in the opposing second axial direction 5 to thereby cause controlled displacement of the adjustment end 21 of the bar 20 in the first axial direction 4. It will be appreciated that the mounting plate 80 operates to prevent the screw 30 from contacting the instrument body (not shown in FIGS. 1-2) when the neck member 10 is attached to said instrument body. The mounting plate 80 receives pressure from the screw 30 and distributes said pressure into the neck member 10, to thereby substantially isolate any such pressure from the instrument body.

It will be appreciated that the features and aspects discussed above provide a number of significant advantages. The pressure isolation provided by the mounting plate 80 permits the neck member 10 to be adjusted in either of the directions 4 or 5 without being attached to the instrument body (not shown in FIGS. 1-2). The plate 80 prevents contact between the screw 30 and the instrument body, thereby inhibiting denting or other deformation of said instrument body. Such deformation is often required when adjusting the neck in prior art guitars since the body provides pressure support to the screw 30 in some cases, resulting in decreased sound quality and/or user dissatisfaction. The pressure-isolating, self-contained nature of the neck member 10 and its adjustment apparatus results in a tighter, more firmly-connected instrument which appeals to the user in terms of better tone quality of the sound output, and a tighter feel.

Figure 10:
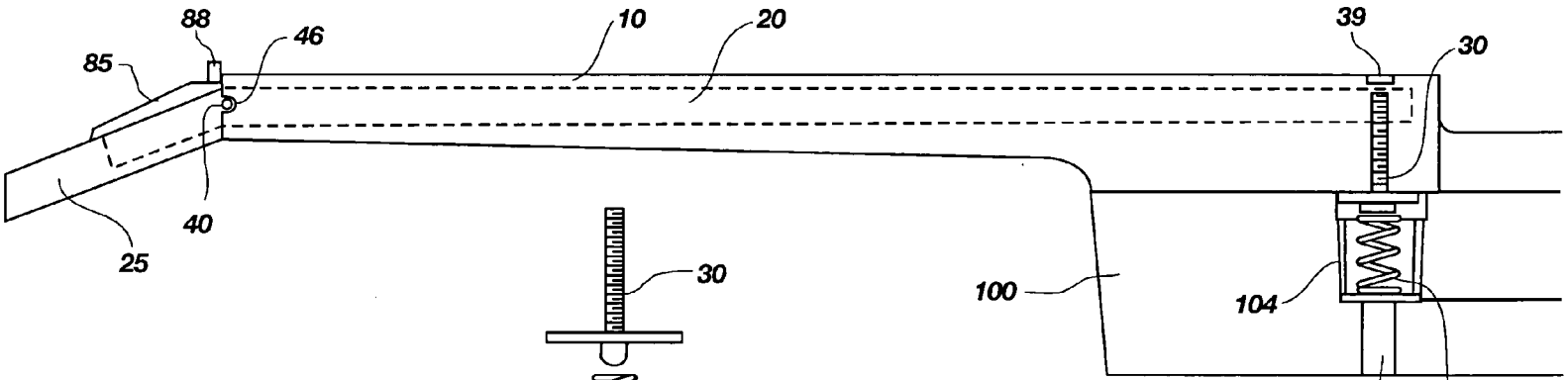
FIG. 10 shows a cut away view of the accessory neck attached to a guitar body with the tension spring disposed within the guitar body.
Figure 9:
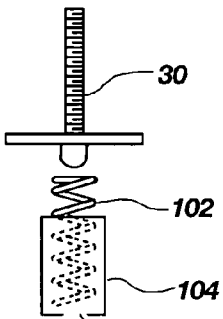
FIG. 9 shows a side view of the tension spring disposed in a partially enclosed cylinder and a screw.

In yet another embodiment, (shown in FIGS. 9 & 10) a pressure-isolation means can be provided by tension spring 102 disposed in a partially enclosed cylinder 104. Cylinder 104 can be disposed in guitar body 100 applying pressure to adjustment mechanism 30 thus reducing unwanted vibration and providing optimal performance to the guitar. A typical adjustment mechanism may be a threaded screw having a blocking flange 35 attached thereto. The accessibility to the adjustment mechanism 30 from the access hole 39 in the top surface 13 or from and access hole 106 in the bottom of cylinder 104 via an access aperture 108 in the guitar body 100 depending on the configuration of the guitar. In this embodiment the spring may apply indirect pressure on the neck member via the blocking flange, thereby reducing the amount of unwanted resonating string vibrations. This may be conducive in instrument that require little to no adjustments in the neck position, and the adjustment mechanism is not completely flush with the recess 37. Furthermore, the pressure-isolating means can aid with accurately applying the proper tension on the strings.

A further advantage results in cases when a shim is placed between the guitar body and the neck member 10 as known in the art to move the neck member 10 closer to the strings 28. A "shim" simply refers to a small piece of wood, cardboard or the like. This practice results in what are referred to in the art as "dead spots", or spacing between the body and the neck member 10 on one or both sides of the shim. The adjustment screw 30 can cause unwanted vibrations or other disturbance in the sound output of the instrument when positioned in certain areas of such dead spots. In some cases, the user must choose between the unwanted sound disturbance, or an imperfect adjustment of the neck member 10, when the desired adjustment results in placement of the flange end 35 in a sound-trouble area of a dead spot. Since the mounting plate 80 of the present invention prevents any part of the screw 30 from venturing beyond the back surface 13 of the neck member 10, this sound disturbance problem is avoided.

Figure 5:
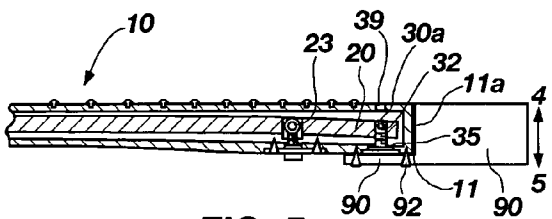
FIG. 5 shows a cut away view of the accessory neck/fingerboard member of FIG. 2, in conjunction with an instrument body and without a mounting plate.

The accessibility to the screw 30 from the access hole 39 in the top surface 13 is also significant. In prior art guitars, the neck portion must be attached to the instrument body in order to adjust the neck, because the body provides necessary pressure to the screw 30 when displacing the adjustment end 21 of the bar 20 in the direction 4. Further, adjustment apparatus in prior art guitars has been accessible only from the back surface 13. The user must drill a hole through the back of the guitar which is smaller than the flange 35 in order to gain access to the screw 30 and maintain contact between the flange 35 and the body. Guitars often have a valuable trademark plate attached to the back surface of the body which also must be penetrated in order to gain access to the screw 30 in the manner described. The access hole 39 thus renders unnecessary any modification of the instrument body in order to adjust the neck member 10 in the directions 4 and/or 5. Thus, the instrument body 90 (FIG. 5) can be used as a restraining means to prevent movement of the screw 30 in the opposing second axial direction 5, with the screw 30 being accessible from the access hole 39. These aspects are especially advantageous in the case of acoustic guitars, wherein modification for adjustment purposes is often particularly undesirable because entry at the back of the guitar requires drilling a hole through the sound plate. The small size of the access hole 39 and its adjacent position relative to the mounting extremity 11*a* render it virtually unnoticeable and substantially removed from the main fingering area of the fingerboard/top surface 14. A further advantage of the access hole 39 is that the user can observe movement of the neck member 10 during the adjustment procedure, making adjustments easier and quicker.

An additional feature in accordance with the present invention is the stabilizing pin 40 which provides stabilization to the guitar neck member 10 when force is applied to the strings. This stabilizing pin 40 is disposed near the distal end 12 of the rigid bar 10. The stabilizing pin 40 is received snuggly into at least one recess 46 when rigid bar 20 is positioned into neck member 10. Typically, the stabilizing pin may be received by a second recess oriented along a common direction with the other recess as shown in FIG. 1. It should be noted, that stabilizing pin 40 rests on the upper and lower portions in the recess 46 but not against the back. This provides stabilization and reduces the deformation or rotational movement of the neck member 10 when string force is applied to the neck member 10. This is more clearly illustrated in FIGS. 8 & 10, where the stabilizing pin 40 rests on the upper and lower portion of recess 46. The addition of a stabilizing pin provides proper neck form when string force is applied. Moreover, the peg head 25 and neck member 10 may be assembled together prior to the cutting and shaping of the peg head and neck member. In other words, a one step cutting and shaping process may be used to fabricate the adjustable neck assembly. In one aspect, a single machine, such as a high speed router, can be used to form the neck assembly. This decreases production time and reduces the amount of tools needed to get the proper neck shape. Moreover, the stabilizing pin eliminates the additional steps of hand fitting and shaping the peg head to the guitar neck.

This stabilizing pin 40 may be a rod, pin, flange or any other type of stabilizing device and can be fabricated of various rigid materials such as high strength polymer and reinforcement fiber, and metals of various types. For example, aluminum and brass are both easily tooled or formed into the appropriate stabilizing configuration. In addition the stabilizing pin may be formed in any shape that can be received into the recess, such as circular, rectangular, square, etc.

Figure 3:
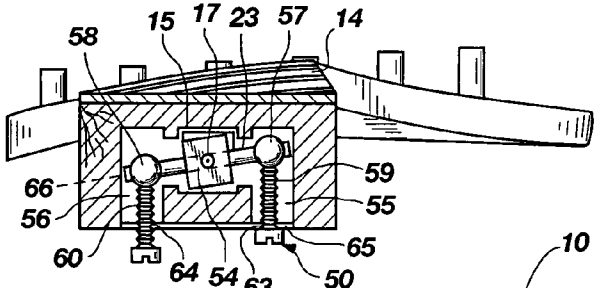
FIG. 3 shows a cut away view taken along the lines 3-3 of FIG. 2, detailing rotational adjustment structure of the present invention.

Additional adjustment capabilities are provided by the present invention in a rotational biasing means 50 which enables rotational adjustment 51 about the bar axis 17, complementing the upward and downward adjustment enabled by the threaded member 30. This rotational biasing means 50 is coupled to the bar near its adjustment end 15 and operates to apply a rotational force 51 along the bar to thereby impose a degree of angular twist to the neck. This aspect of the invention is more clearly illustrated in FIG. 3. FIG. 3 illustrates one embodiment of the rotational biasing means 50 wherein means are provided for imposing angular displacement to the transverse pivot support 23 which operates as a fulcrum point for vertical adjustment of the bar. In this embodiment, the pin 23 is dimensioned to fit closely within the traverse opening 54 at the pivot of the bar. Channels 55 and 56 are cut into the neck structure and communicate with the bar channel 15. Opposing ends of the pin 23 extend to each of these channels and interlock with an annular receiving member 57 and 58 wherein the annulus receives the distal ends of the pin 23. Each receiving member 57 and 58 is coupled to a biasing screw 59 and 60 which is threaded and journaled in a threaded opening 63 and 64 of a rigid mounting plate 65. Operation of the rotational biasing means is accomplished by counter rotation of the respective biasing at opposing ends of the pin 23, causing the pin to twist about the axis 17 of the bar. This loads a rotational force on the bar 20 along its length, causing the more narrow portion of the neck 12 to twist in the manner illustrated in FIG. 3. In this figure, the fingerboard/top surface 14 is shown twisted in a counter clockwise direction in response to the respective raised 59 and lowered 60 biasing screws. It will be apparent to those skilled in the art that this figure is greatly exaggerated and that the degree of twist actually opposed would barely be perceptible to the human eye. Accordingly, FIG. 3 has rotational movements which are greatly enhanced.

The use of two biasing screws 59 and 60 in FIG. 3 assist in stabilizing the rotated bar in a fixed position. For example, a single biasing screw in the illustrated configuration would permit the bar 20 to shift somewhat, depending upon the amount of channel space 15 available. The two biasing screws 59 and 60 cooperate to fix the relative position of the pin axis 66 and the bar axis 17 so that an adjustment which is made to the fingerboard remains fixed and stable.

Figure 4:
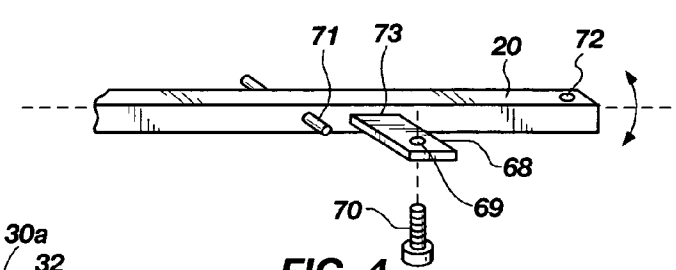
FIG. 4 shows an alternate embodiment of the rotational structure illustrated in FIG. 3.

FIG. 4 illustrates an additional example of a means for biasing the bar 20 to a rotated configuration with results similar to those shown in FIG. 3. Specifically, this embodiment includes a lateral tab 68 having a threaded opening 69 for receiving a bias screw 70. This bias screw 70 would be secured through a plate 65 as shown in FIG. 3. An advantage of the latter embodiment is its displacement from the pivot pin 71 which is utilized to provide the vertical displacement associated with threaded opening 72, as illustrated in FIG. 2 with item 30. The tab is adjusted upward or downward to impose appropriate rotation and provides the desired stability because of its rigid attachment 73 to the bar. Such attachment may be by welding or other permanent fixation.

Each structural feature is generally representative of a general method for bi-directional control of adjustment of the neck and fingerboard at any given plane of a stringed instrument. For example, vertical adjustment of the neck member 10 (adjustment in directions 4 and 5) occurs within a plane which is normal to the fingerboard and coplanar with the axis of the bar. Rotational adjustment of the neck member 10 occurs within a plane which is normal to the axis of the bar (forming a cross section in the bar and neck). The actual steps of the inventive method are applied with respect to an instrument which includes a rigid bar disposed within a channel as previously described herein, located within the neck and extending along the length of the neck as is shown in FIG. 2.

The method is practiced by providing a close dimensional fit between the distal end 22 of the bar 20 and the distal end of the channel 15 such that bi-directional displacement of said distal end 22 along the rotational or vertical axis results in a corresponding displacement of the distal end 12 of the neck member 10. Put another way, forces applied to the bar 20 are transferred from the side walls of the channel 15 such that the neck member 10 becomes bent or twisted accordingly.

A second step of this method involves coupling a bi-directional, threaded adjustment mechanism (previously described as either item 30 or item 50) to the adjustment end of the bar, and then rotating and/or counter rotating this threaded adjustment mechanism to impose bi-directional displacement forces therefrom to the distal end 22 of the bar 20.

More specifically, vertical adjustment is accomplished by coupling the threaded adjustment mechanism through a threaded opening 33 in the adjustment end 21 of the bar 20 and rotating the adjustment mechanism clockwise or counter clockwise to enable the desired vertical adjustment in either upward or downward directions. Rotational adjustment is similarly accomplished by coupling the threaded adjustment mechanism to the adjustment end 21 of the bar 20 in tangential, offset relationship with the bar axis and then rotating the mechanism to apply rotational force to the bar 20.

The advantages of the present invention in broad context extend from initial stages of construction, up through the final use of the instrument in actual performance. For example, the various adjustments available with the present invention enable greater utility for necks which may be deformed in fabrication procedures. Instead of throwing the neck away, vertical or rotational adjustments are applied after assembly to straighten the neck member 10 to a proper orientation. A major advantage of the present invention is that such adjustments can be made without attaching the neck member 10 to the instrument body, as has been required by prior art structures and methods. The present invention permits bi-directional adjustment in both directions 4 and 5, and in rotational and counter rotational orientation without strings, trusses of other exterior forces. Furthermore, because the bar 20 is tied into the guitar body with full adjustment capability, much improved retention of tuning pitches is provided, despite the most heavy application of tremolo and other rough forms of treatment.

The present invention even permits greater versatility in finish work on the instrument and enhanced capability for extended warranty. For example, whereas prior instruments were seldom warranted unless the neck was totally sealed by varnish or other finishes from the effects of humidity and weather, the present instrument does not require such a finish. If slight deflection occurs because of weather conditions, or even abuse, the neck can be straightened by making appropriate vertical and rotational adjustments to the bar which carries the dominant load of force imposed by the guitar strings. This mechanism therefore enables extended warranties which can be honored by merely making adjustments within the neck adjustment structure. These are only a few of the examples and benefits that arise because of this greatly advanced adjustment mechanism.

The present invention represents a significant advance in the field of accessory necks in stringed instruments. It is noted that many, but not all, of the advantages of the present invention result from the access hole 39 in the fingerboard/top surface 14, and from the support plate 80. The provision of the access hole 39 in the top surface 14 provides the advantages that a user can replace or adjust the neck member 10 without modifying the instrument body and need not purchase a new trademark plate after having drilled a hole through it. The user can observe movement of the neck member 10 during the adjustment procedure by accessing the screw 30 from the access hole 39. It will be appreciated that when the access hole 39 is very small (between ⅛ of an inch and 3⁄16 of an inch) and located within about 0.5 inches of the extremity 11*a*, it is substantially unnoticeable to the user and does not disturb the fingerboard/top surface 14 or irritate the user.

The plate 80 isolates pressure in the screw 30 from the instrument body, preventing deformation of the body and disturbance of the sound output. The plate 80 allows the neck member 10 to be adjusted independent of attachment to the instrument body. The problems associated with the prior art accessory neck members and neck adjustment structures are overcome to a significant degree by the present invention. Those skilled in the art will appreciate from the preceding disclosure that the objectives stated above are advantageously achieved by the present invention.

It is to be understood that the principles in accordance with the present invention can be applied to non-accessory neck members in stringed instruments. Put another way, the neck members need not be interchangeable but can be permanently attached to the body. Further, the invention can be applied to acoustic and electric stringed instruments alike. It is to be understood that the above-described arrangements are only illustrative of the application of the principles of the present invention. Numerous modifications and alternative arrangements may be devised by those skilled in the art without departing from the spirit and scope of the present invention. For example, the rigid bar 20 need not be attached to the peg head 25; although the neck member 10 would then bear the string tension, the advantages provided by the access hole 39 and support plate 80 can occur with a rigid bar 20 which only extends along a portion of the channel 15. Further, the cross sections of the channel 15 and the rigid bar 20 need not be square, but may alternatively be of any non-circular shape in order to provide the cooperative engagement therebetween as described above.

It is further to be understood that the advantages provided by the support plate 80 can be obtained without provision of the access hole 39. For example, the plate 80 could be provided with an access hole smaller than the flange 35, in which case a screw turning device would turn the screw 30 from the flange end 35 instead of from the second end 30*a*. The advantages of pressure isolation from the body, and adjustability independent of attachment to the body, would still be obtained without the access hole 39.

Further, the advantages provided by the access hole 39 can be obtained without provision of the support plate 80. Although the screw 30 would require the support of the body for adjustment of the neck member 10 in direction 5, the adjustments could be made while observing the movement of the neck member 10, and without modification to the body.

Numerous other modifications and arrangements not specifically mentioned herein are within the scope of the present invention, and the appended examples are intended to cover such modifications and arrangements.

It will be apparent to those skilled in the art that these methods can be practiced with respect to stringed instruments of a variety of construction and that the specific structure disclosed in this description is merely exemplary of several preferred embodiment thereof. Accordingly, it is to be understood that the examples are not to be limited by the specific examples provided herein, but are to be construed in accordance with the following examples.

What is claimed is:

1. An adjustable neck member for a stringed instrument, comprising:

a mounting end configured to be coupled to a stringed instrument body;

a distal end;

an enclosed channel extending within the neck member from a position near the mounting end and along a central axis of the neck member to the distal end, said channel including at least one recess extending laterally from the channel at the distal end; and a rigid bar disposed within the channel and having (i) an adjustment end configured for positioning proximate to the instrument body and configured to receive an adjustment mechanism; (ii) an opposing distal end extending toward the distal end of the neck member; (iii) a stabilizing pin disposed near the distal end to be received in said at least one recess; and (iv) a transverse pivot support coupled proximate to the mounting end of said bar, thereby enabling the neck member to vertically displace;

a peg head rigidly coupled to the distal end of the rigid bar;

said adjustment mechanism being configured to engage the adjustment end of the rigid bar for enabling the neck member to vertically displace said stabilizing pin and said at least one recess being configured to reduce rotational movement between the peg head and the distal end.

2. The adjustable neck member of claim 1, further comprising a pressure isolating means having a partially enclosed cylinder configured for mounting within the instrument body, a blocking flange coupled to the adjustment mechanism and a spring disposed between the flange and the cylinder, wherein the pressure isolating means is capable of indirectly applying sufficient pressure to the neck member to reduce any resonating spring vibrations.

3. The adjustable neck member of claim 2, wherein the partially enclosed cylinder includes a bottom surface having an aperture for allowing access to the adjustment mechanism.

4. The peg head of claim 1, further comprising at least one adjustment peg configured for attaching and adjusting of at least one instrument string.

5. The adjustable neck member of claim 1, further comprising a support plate coupled to the peg head, said support plate capable of maintaining at least one instrument string at a predetermined distance above the neck member.

6. The adjustable neck member of claim 5, wherein the support plate is capable of receiving an optional standard nut or a locking nut.

7. The adjustable neck member of claim 5, wherein the predetermined distance is capable of being adjusted by manipulating a height of the support plate with spacing elements.

8. The adjustable neck member of claim 5, wherein said support plate is secured to the peg head and to the distal end of the rigid bar by at least one screw.

9. The adjustable neck member of claim 8, wherein the access hole has a substantially circular shape and a diameter within a range of about ⅛ of an inch to about 3/16 of an inch.

10. The adjustable neck member of claim 1, further comprising a finger board/top surface coupled to the neck member and an access hole formed in said top surface for accessing the adjustable mechanism.

11. The adjustable neck member of claim 1, wherein the rigid bar and channel are rectangularly configured and sized to restrain relative rotational movement of the distal end of the bar with respect to the distal end of the neck.

12. The adjustable neck member of claim 1, wherein the stabilizing pin is configured to securely fit within the recess to substantially prevent rotational moment of the neck member.

13. The adjustable neck member of claim 1, wherein a standard nut or locking nut is optionally disposed on the distal end of the said neck member.

14. The adjustable neck member of claim 1, further comprising a second recess oriented along a common direction with said recess.

15. An adjustable neck member for a stringed instrument, comprising:

a mounting end configured to be coupled to a stringed instrument body;

a distal end;

an enclosed channel extending within the neck member from a position near the mounting end and along a central axis of the neck member to the distal end, said channel including at least one recess extending laterally from the channel at the distal end;

a rigid bar disposed within the channel and having (i) an adjustment end configured for positioning proximate to the instrument body and configured to receive an adjustment mechanism; (ii) an opposing distal end extending toward the distal end of the neck member; (iii) a stabilizing pin disposed near the distal end to be received in said at least one recess and configured to reduce rotational movement between the rigid bar and said distal end; and (iv) a transverse pivot support coupled proximate to the mounting end of said bar, thereby enabling the neck member to vertically displace; and a pressure isolating means having a partially enclosed cylinder configured for mounting within the instrument body, a blocking flange coupled to the adjustment mechanism and a spring disposed between the flange and the cylinder, wherein the pressure isolating means is capable of indirectly applying sufficient pressure to the neck member to reduce any resonating spring vibrations;

said adjustment mechanism being configured to engage the adjustment end of the rigid bar for enabling the neck member to vertically displace.

* * * * *